US010415272B1

(12) United States Patent
Tuttle

(10) Patent No.: US 10,415,272 B1
(45) Date of Patent: Sep. 17, 2019

(54) MULTIPLE-LOCK SECURING SYSTEM

(71) Applicant: Terry P. Tuttle, Clarkdale, AZ (US)

(72) Inventor: Terry P. Tuttle, Clarkdale, AZ (US)

( * ) Notice: Subject to any disclaimer, the term of this patent is extended or adjusted under 35 U.S.C. 154(b) by 0 days.

(21) Appl. No.: 16/175,697

(22) Filed: Oct. 30, 2018

(51) Int. Cl.
*E05B 67/00* (2006.01)
*E05B 67/38* (2006.01)
*E05B 35/08* (2006.01)

(52) U.S. Cl.
CPC ..... *E05B 67/383* (2013.01); *E05B 35/08* (2013.01)

(58) Field of Classification Search
CPC ..... E05B 67/383; E05B 35/08; E05B 17/00; E05B 63/143; E05B 67/003; E05B 67/388; G05G 5/005
USPC ..... 70/14, 18, 19, 51, 53, 58, DIG. 63; 292/148
See application file for complete search history.

(56) References Cited

U.S. PATENT DOCUMENTS 2,963,895 A * 12/1960 Thomas ..... E05B 67/383 292/288
3,889,497 A 6/1975 Tuttle
3,988,031 A * 10/1976 Meyer ..... E05B 67/383 292/153
4,085,599 A * 4/1978 Fischer ..... E05B 67/383 70/14
4,864,834 A * 9/1989 Waite ..... E05B 67/383 70/14
D339,057 S * 9/1993 Lofland ..... D8/343
5,582,042 A * 12/1996 Mordick ..... E05B 67/383 70/14
5,868,015 A * 2/1999 Eaker ..... E05B 67/383 292/148
7,503,194 B2 * 3/2009 McNeil ..... E05B 67/383 248/552
7,690,229 B2 * 4/2010 McKee ..... E05B 67/383 292/148
9,273,490 B1 * 3/2016 McNeil ..... E05B 17/00

* cited by examiner

*Primary Examiner* — Suzanne L Barrett
(74) *Attorney, Agent, or Firm* — Thomas I. Rozsa

(57) ABSTRACT

A multiple-lock securing system to provide access to a secured area by releasing one of a plurality of locks. A bar in a multiple-lock securing system provides access to a secured area by releasing one of the locks. A locking plate has a plurality of openings for positioning one of the locks therein. The bar is fastened to the locking plate when the locks are positioned in each of the openings. Removal of one of the locks from its respective opening releases the bar and provides access to the secured area. The invention provides an improved multiple lock securing system that includes end bars and middles bars with structural differences to accommodate larger locks. The invention further provides end bars and middle bars that have a stiffening center rib that extends through the central axis of each bar.

9 Claims, 6 Drawing Sheets

MULTIPLE-LOCK SECURING SYSTEM

BACKGROUND OF THE INVENTION

1. Field of the Invention

The present invention relates to the field of locking mechanisms. Specifically, the present invention relates to locking mechanisms having multiple locks to access the same opening.

2. Description of the Prior Art

The following patent is the closest prior art known to the inventor:

U.S. Pat. No. 3,889,497 issued to Herman L. Tuttle on Jun. 17, 1975 for "Multiple-Lock Securing System" (hereafter the "'497 Patent"). The present invention by Terry P. Tuttle, the son of inventor Herman L. Tuttle, is an improvement over the invention disclosed and claimed in the '497 Patent.

SUMMARY OF THE INVENTION

The present invention is an improved multiple-lock securing system to provide access to a secured area by releasing one of a plurality of locks. A bar in a multiple-lock securing system provides access to a secured area by releasing one of the locks. A locking plate has a plurality of openings for positioning one of the locks therein. The bar is fastened to the locking plate when the locks are positioned in each of the openings. Removal of one of the locks from its respective opening releases the bar and provides access to the secured area.

It is an object of the present invention to provide an improved multiple lock securing system that includes end bars and middles bars with structural differences to accommodate larger locks.

It is also an object of the present invention to provide end bars and middle bars that have a stiffening center rib that extends through the central axis of each bar.

It is an additional object of the present invention to provide end bars that have a larger U-shaped opening in the locations where each shackle of a plurality of locks connects to each locking plate.

It is still a further object of the present invention to provide middle bars that have a larger U-shaped opening in the locations where each shackle of a plurality of locks connects to each locking plate.

Further novel features and other objects of the present invention will become apparent from the following detailed description, discussion and the appended claims, taken in conjunction with the drawings.

BRIEF DESCRIPTION OF THE DRAWINGS

Referring particularly to the drawings for the purpose of illustration only and not limitation, there is illustrated.

DETAILED DESCRIPTION OF EMBODIMENTS OF THE

Present Invention

Although specific embodiments of the present invention will now be described with reference to the drawings, it should be understood that such embodiments are by way of example only and merely illustrative of but a small number of the many possible specific embodiments which can represent applications of the principles of the present invention. Various changes and modifications obvious to one skilled in the art to which the present invention pertains are deemed to be within the spirit, scope and contemplation of the present invention as further defined in the appended claims.

Among the improvements in the present invention are improved end bars and an improved middle bar which facilitate the use of locks having much larger shackle widths or stronger locks. Further the improved end bars allow for use of chains having a greater thickness or stronger chains.

Figure 1:
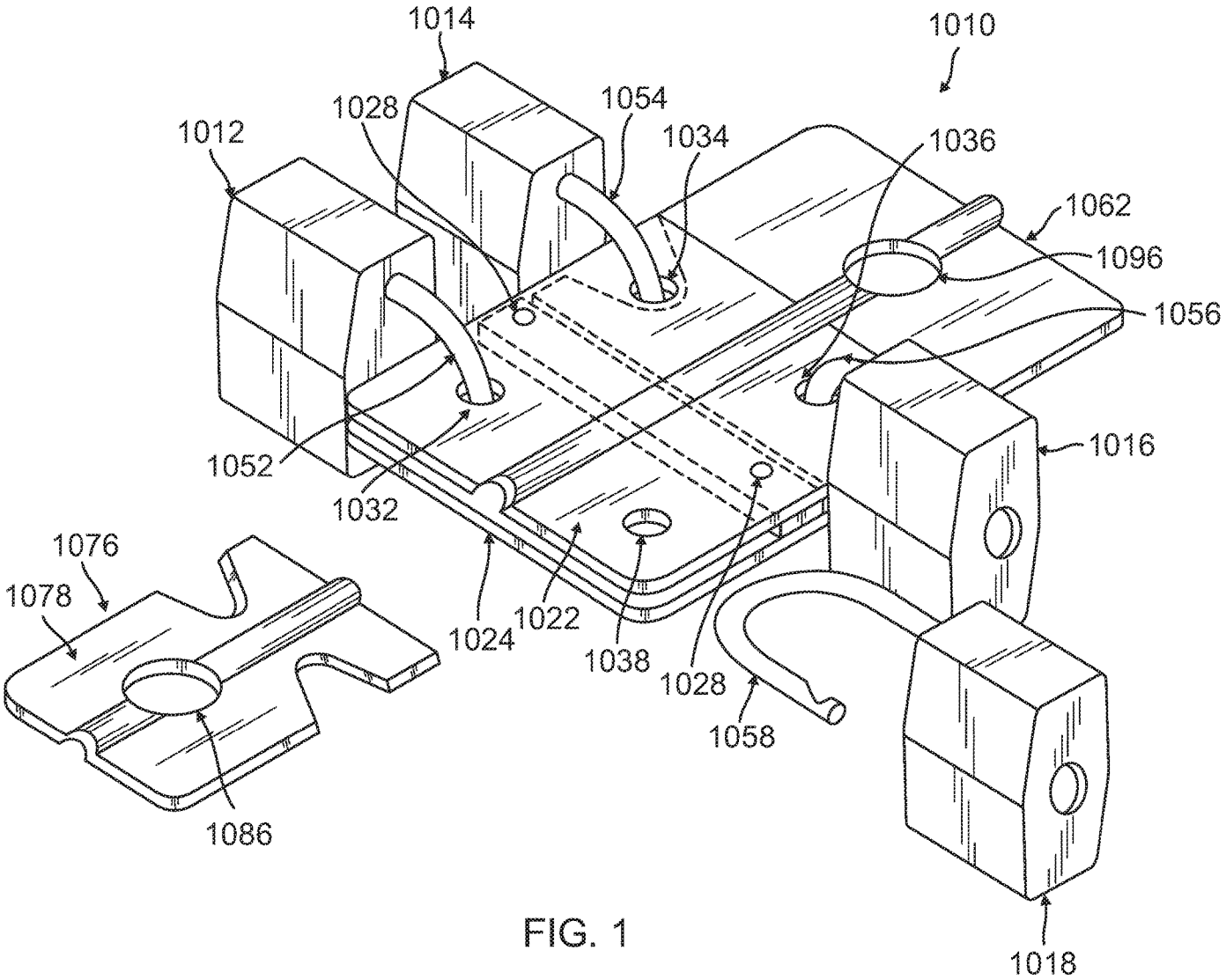
FIG. 1 is a top perspective view of the present invention improved multiple-lock securing system illustrating an end bar removed from the locking plate and three of the four locks having closed shackles affixed to the locking plate.
Figure 1A:
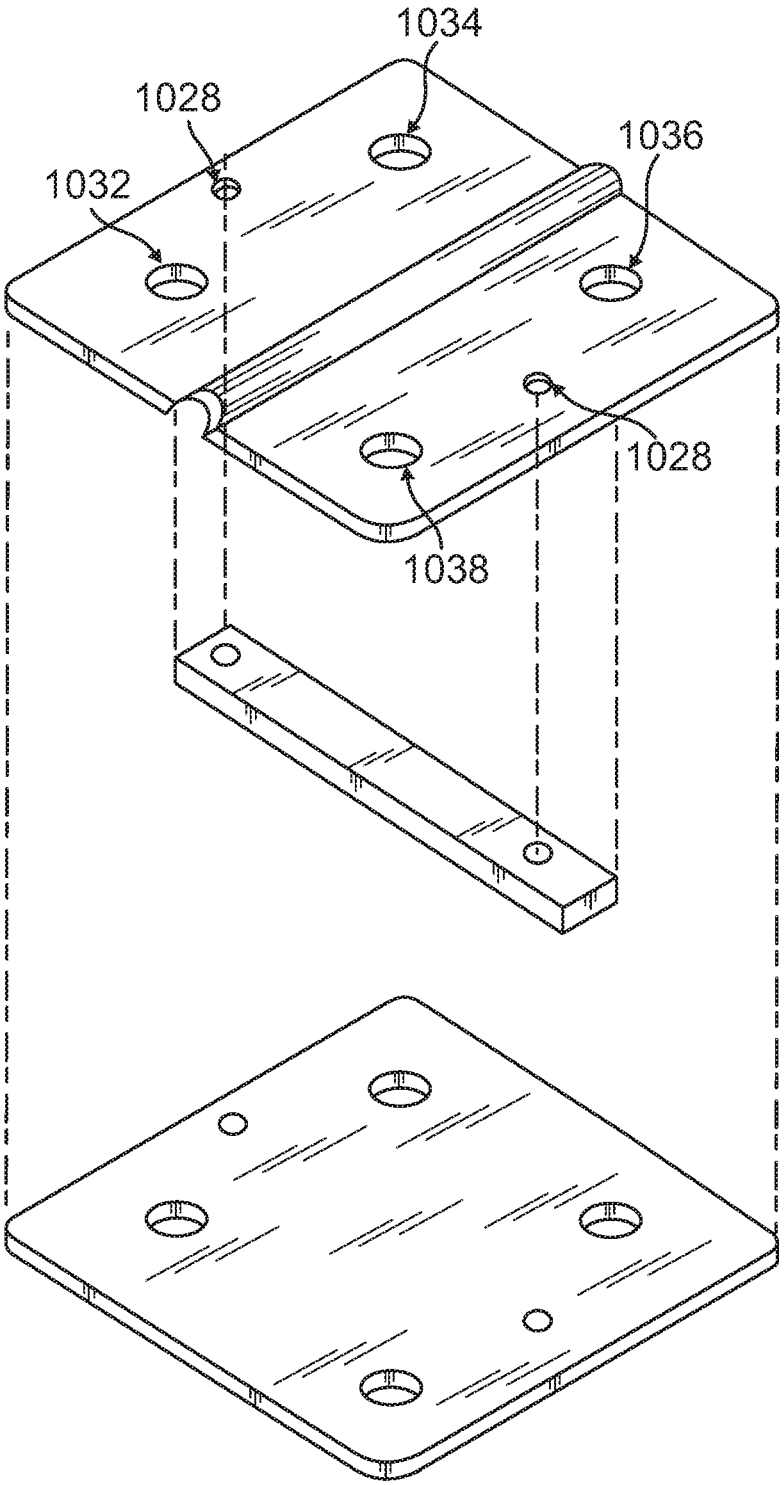
FIG. 1A is an exploded perspective view of the locking plate taken from FIG. 1.
Figure 2:
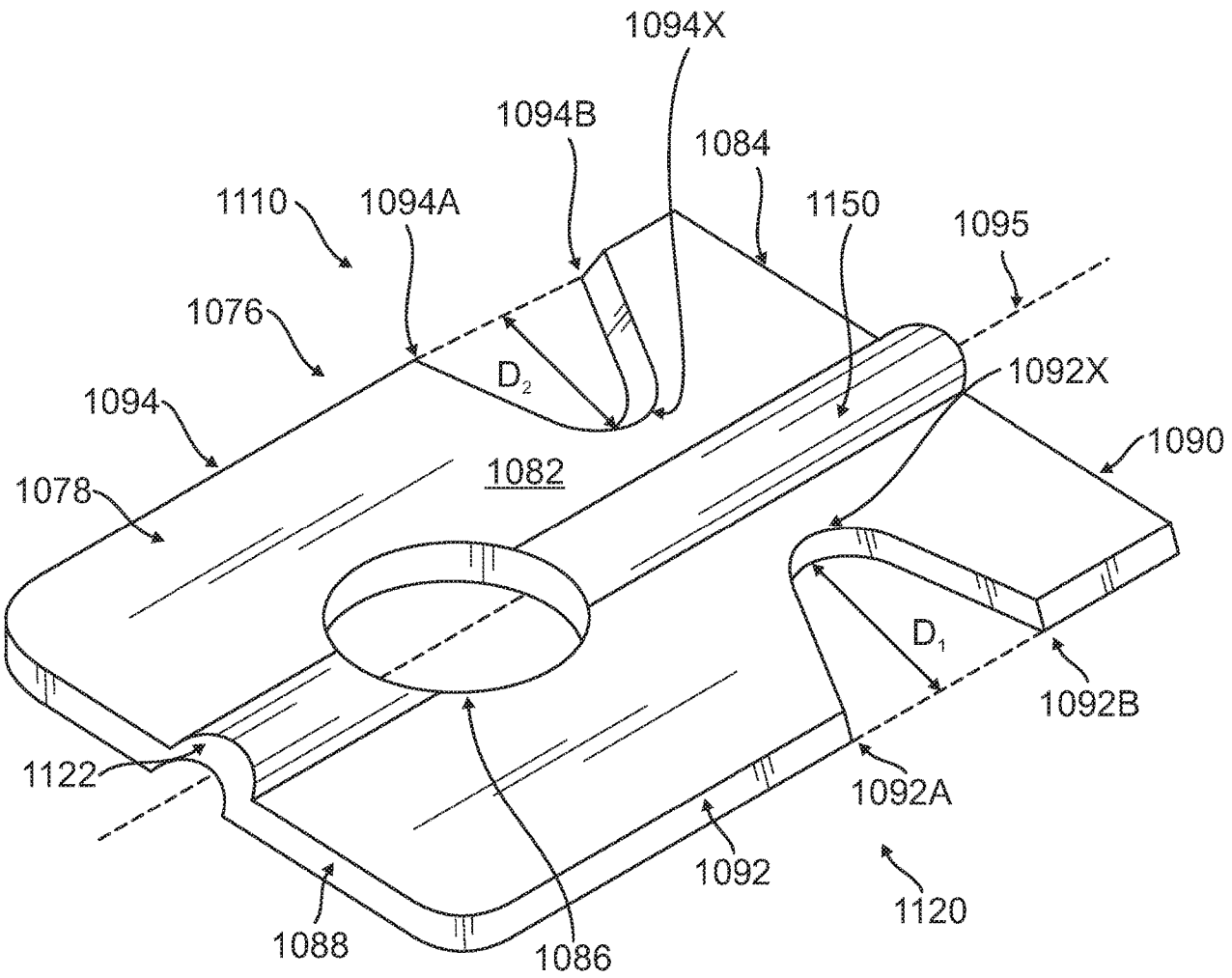
FIG. 2 is an enlarged top perspective view of an improved end bar.

Referring to FIGS. 1, 1A and 2, there is illustrated a top perspective view of the present invention improved multiple-lock securing system 1010 illustrating a first improved end bar 1076 removed from upper locking plate 1022 and lower locking plate 1024. Also illustrated are locks 1012, 1014, 1016, and 1018 with locks 1012, 1014, and 1016 having respective closed shackles 1052, 1054, and 1056. Lock 1018 is illustrated having an open shackle 1058. As illustrated in FIG. 1, three out of the four locks have closed shackles affixed to the locking plate.

One improvement over the '497 Patent is a substantially improved end bar design. The end bar (76) in the '497 Patent has a rectangular shape with squared interior corners. The significantly improved end bar 1076 of the present invention has openings 1094A and 1094B thereby substantially facilitating the removal of the end bar from between two locking plates 1022 and 1024. A second significant improvement is the addition of a strengthening rib 1150 in the improved end bar 1076. The strengthening rib provides additional strength to reduce the possibility of the end bar 1076 breaking under the weight of the locks and breaking when the end bar 1076 is removed between the locking plates 1022 and 1024. A semi-circular cutout and matching strengthening rib 1152 is formed in the upper locking plate 1022. This combination strengthening rib in the end plate 1076 (and a corresponding opposite end plate) and stiffening rib in the upper locking plate 1022 also provides additional strength to reduce the possibility of the multiple-lock structure 1010 breaking under the weight of the locks and breaking when the end bar 1076 is removed between the locking plates 1022 and 1024. The corners 1040A, 1040B, 1040C and 1040C of the end plate 1076 are rounded.

Referring to FIGS. 1 and 1A, substantially rectangular upper locking plate 1022 and substantially rectangular lower locking plate 1024 are positioned in parallel planes. The upper locking plate 1022 and lower locking plate 1024 are similar in size and have their peripheries aligned in common planes. The plates are separated from each other by means of a spacer 1026 which extends transversely at the center of the plates and is positioned between upper locking plate 1022 and lower locking plate 1024. The plates and spacer 1026 are secured together by means of rivets 1028. Upper locking plate 1022 contains upper openings 1032, 1034, 1036, and 1038 respectively located at approximately a center of a corner portion 1032C, 1034C, 1036C, 1038C of upper locking plate 1022. These openings are aligned with similar lower openings 1042, 1044, 1046, and 1048 in the lower locking plate 1024, respectively. As illustrated in FIG. 1, the first lock 1012 is shown secured to the upper and lower locking plates 1022 and 1024. The first lock 1012 contains a shackle 1052 which passes through the aligned openings 1032 and 1042, of the upper and lower locking plates 1022 and 1024, respectively. The second lock 1014 and third lock 1016 are shown in similar a locked position. The fourth lock 1018 is illustrated unlocked with its shackle 1058 removed from the respective openings 1038 and 1048 of the upper and lower locking plates 1022 and 1024.

Figure 3:
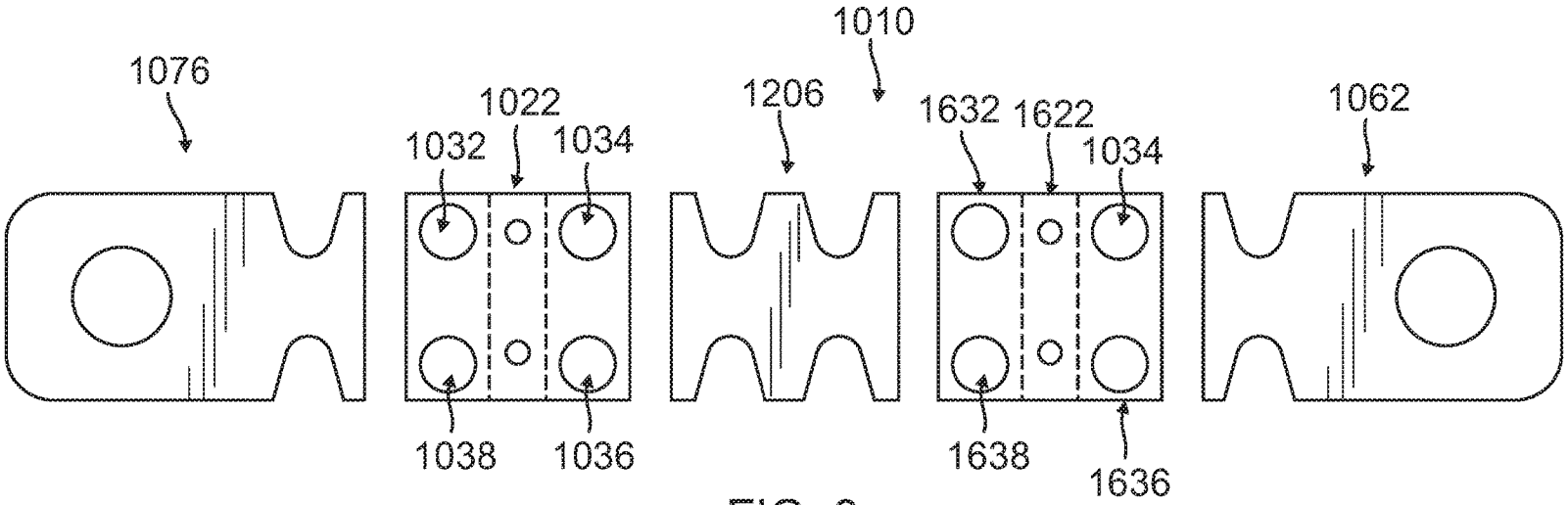
FIG. 3 is an exploded view of a schematic of the improved multiple-lock securing system illustrating from left to right, an improved first end bar, a first locking plate, an improved middle bar, a second locking plate, and an improved second end bar.
Figure 4:
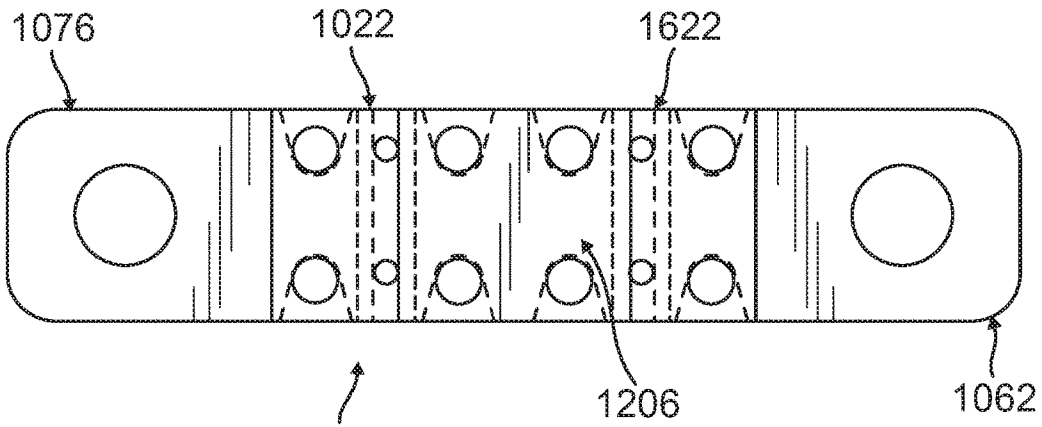
FIG. 4 is a top view of the elements listed in FIG. 3 positioned together during operation of the present invention improved multiple-lock securing system.

Referring to FIG. 2, a first improved end bar 1076 is illustrated removed from the present invention improved multiple-lock securing system 1010. First improved end bar 1076 when inserted, as illustrated in FIG. 3 and FIG. 4, fits between upper and lower locking plates 1022 and 1024. First improved end bar 1076 has a body 1078 having a centrally located opening 1086 with an end bar first side 1088, an end bar second side 1090, an end bar third side 1092, an end bar fourth side 1094, an end bar top surface 1082 and an end bar bottom surface 1084. First improved end bar 1076 also has a central axis 1095 which divides a first half 1110 and a second half 1120 with first half 1110 being symmetrical to and a mirror image of second half 1120.

First side 1088 contains a centrally located semicircular cutout 1122 that extends the width of strengthening rib 1150 along first side 1088. Strengthening rib 1150 extends from end bar first side 1088 to end bar second side 1090. Strengthening rib 1150 has the width of semi-circular cut out 1122. It is within the spirit and scope of this invention for this strengthening rib to be wider or narrower than the width of semicircular cutout 1122.

The widths of end bar first side 1088, end bar second side 1090, end bar third side 1092, and end bar fourth side 1094 define the perpendicular distance between end bar top surface 1082 and end bar bottom surface 1084. This width is typically between 0.1 cm and 0.5 cm, but it is within the spirit and scope of this invention for this width to be smaller or larger.

End bar third side 1092 has a substantially U-shaped cutout that is defined by a sidewall that extends from a first opening 1092A and a second opening 1092B inwardly at oppositely converging angles for a perpendicular distance D1 towards end bar central axis 1095 and terminates at an apex 1092X.

Similarly, end bar fourth side 1094 has a substantially U-shaped cut out that is defined by a sidewall that extends from a first opening 1094A and a second opening 1094B inwardly at oppositely converging angles for a perpendicular distance D2 towards end bar central axis 1095 and terminates at an apex 1094X. Apex 1092X is located at a distance closer to end bar central axis 1095 than to end bar third side 1092. Similarly, apex 1094X is located at a distance closer to end bar central axis 1095 than to end bar fourth side 1094.

Referring to FIG. 2, first end bar has rounded corners 1040A, 1040B, 1040C and 1040D. Specifically, the intersection of first side 1088 and fourth side 1092 is rounded corner 1040A. The intersection of first side 1088 and third side 1094 is corner 1040B. The intersection of second side 1090 and third side 1092 is corner 1040C. The intersection of second side 1090 and fourth side 1092 is 1040D.

Referring to FIG. 3 there is illustrated an exploded view of a schematic of the improved multiple-lock securing system 1010 illustrating from left to right, an improved first end bar 1076, a first locking plate 1022, an improved middle bar 1206, a second locking plate 1622, and an improved second end bar 1062.

Referring to FIG. 4, there is illustrated a top view of the elements listed in FIG. 3 positioned together during operation of the present invention improved multiple-lock securing system 1010.

Figure 5:
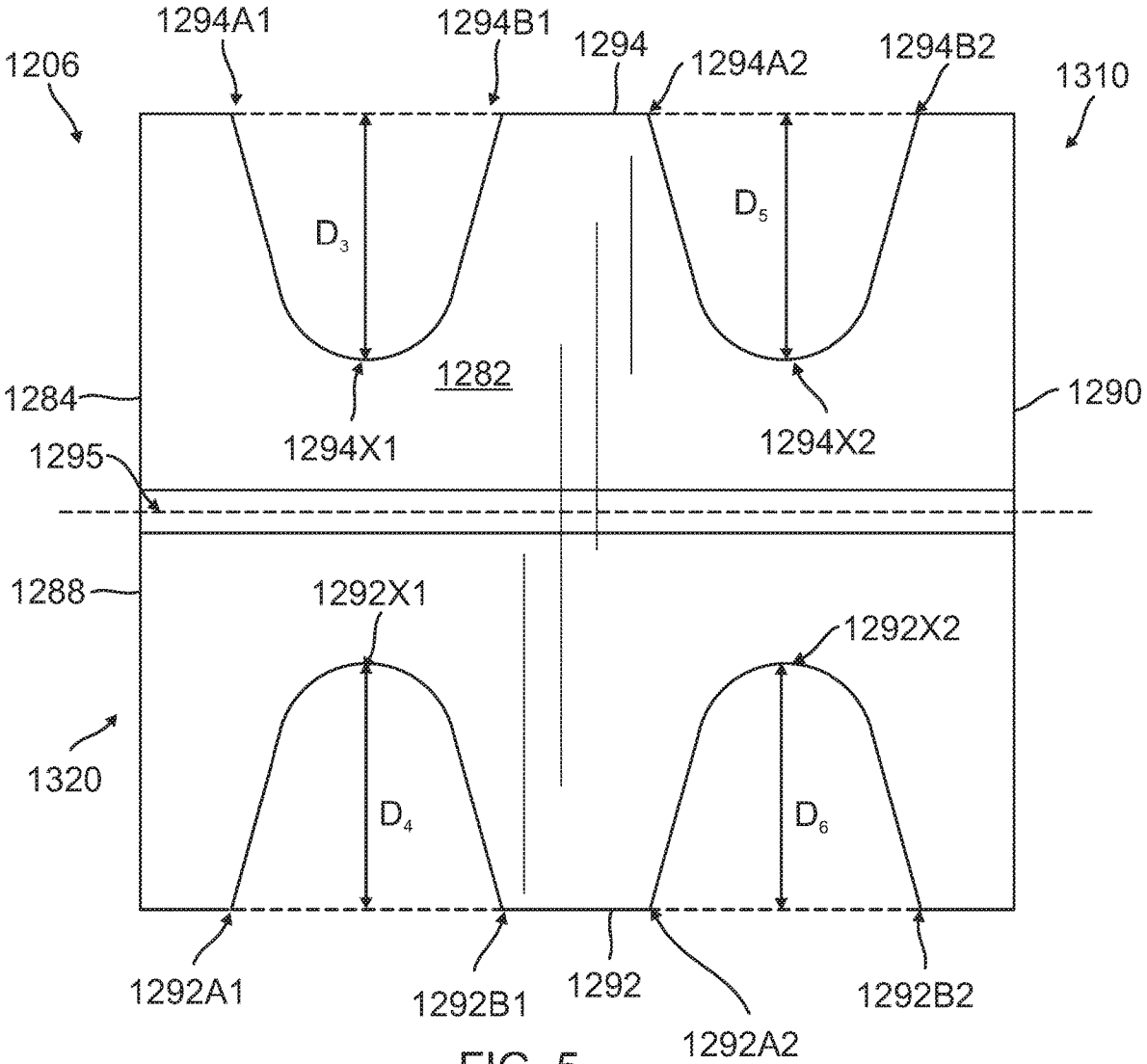
FIG. 5 is an enlarged top plan view of an improved middle bar.

Referring to FIG. 5, there is illustrated an improved middle bar 1206 having a middle bar first side 1288, a middle bar second side 1290, a middle bar third side 1292, a middle bar fourth side 1294, a middle bar top surface 1282 and a middle bar bottom surface 1284. First improved middle bar 1206 also has a middle bar central axis 1295 which divides a first half 1310 and second half 1320 with first half 1310 being symmetrical to and a mirror image of second half 1320. This is a significant improvement over the "I" connector illustrated in FIG. 4 of the '497 patent. The new innovative connector section 1206 provides additional strength for extended connection of multiple locking members.

The widths of middle bar first side 1288, middle bar second side 1290, middle bar third side 1292, and middle bar fourth side 1294 define the perpendicular distance between middle bar top surface 1282 and middle bar bottom surface 1284. This width is typically between 0.1 cm and 0.5 cm, but it is within the spirit and scope of this invention for this width to be smaller or larger.

Middle bar third side 1292 has a first substantially U-shaped cutout that is defined by a sidewall that extends from a first opening 1292A1 and a second opening 1292B1 inwardly at oppositely converging angles for a perpendicular distance D4 towards middle bar central axis 1295 and terminates at an apex 1292X1. Middle bar third side 1292 also has a second substantially U-shaped cutout that is defined by a sidewall that extends from a first opening 1292A2 and a second opening 1292B2 inwardly at oppositely converging angles for a perpendicular distance D6 towards middle bar central axis 1295 and terminates at an apex 1292X2.

Middle bar fourth side 1294 has a first substantially U-shaped cutout that is defined by a sidewall that extends from a first opening 1294A1 and a second opening 1294B1 inwardly at oppositely converging angles for a perpendicular distance D3 towards middle bar central axis 1295 and terminates at an apex 1294X1. Middle bar fourth side 1294 also has a second substantially U-shaped cutout that is defined by a sidewall that extends from a first opening 1294A2 and a second opening 1294B2 inwardly at oppositely converging angles for a perpendicular distance D5 towards middle bar central axis 1295 and terminates at an apex 1294X2. Distances D3, D4, D5, and D6 are substantially equal in length. Apexes 1292X1 and 1292X2 are located at a distance closer to middle bar central axis 1295 than to middle bar third side 1292. Similarly, apexes 1294X1 and 1294X2 are located at a distance closer to middle bar central axis 1295 than to middle bar fourth side 1294.

Referring to FIG. 3, it is illustrated that the U-shaped openings of end bar 1076 align over holes 1032 and 1038. Similarly, the U-shaped openings of middle bar 1206 align over holes 1034, 1036, 1632, and 1638 respectively when positioned together as illustrated in FIG. 4. Lastly, the U-shaped openings of end bar 1062 align over holes 1634 and 1636. As illustrated in the figures, end bar 1076 is equal in size and dimensions to end bar 1062.

In operation and as illustrated in FIG. 1, improved end bar 1076 is secured between upper locking plate 1022 and lower locking plate 1024 by locks 1012 and 1018, in the same manner as bar 1062 is secured by locks 1014 and 1016. When shackle 1058 is removed from opening 1038 and 1048, improved end bar 1076 can be removed from the plates as illustrated in FIG. 1. With shackle 1058 removed, end 1090 is slid between locking plates 1022 and 1024 and second opening 1094B if rotated around shackle 1052 until the entire end piece 1076 is removed from locking plates 1022 and 1024. Similarly, improved end bar 1076 can be removed by releasing shackle 1052 of lock 1012. The embodiment of FIG. 1 has been described as connecting the end links of a first chain not illustrated) that would pass through hole 1086 of first improved end bar 1076 and a second chain (not illustrated) that would pass through hole 1096 of second improved end bar 1062. The other ends of the first chain and second chain are each normally secured to a permanent structure such as a post or a wall (not illustrated) thus completing an integral structure.

Figure 6:
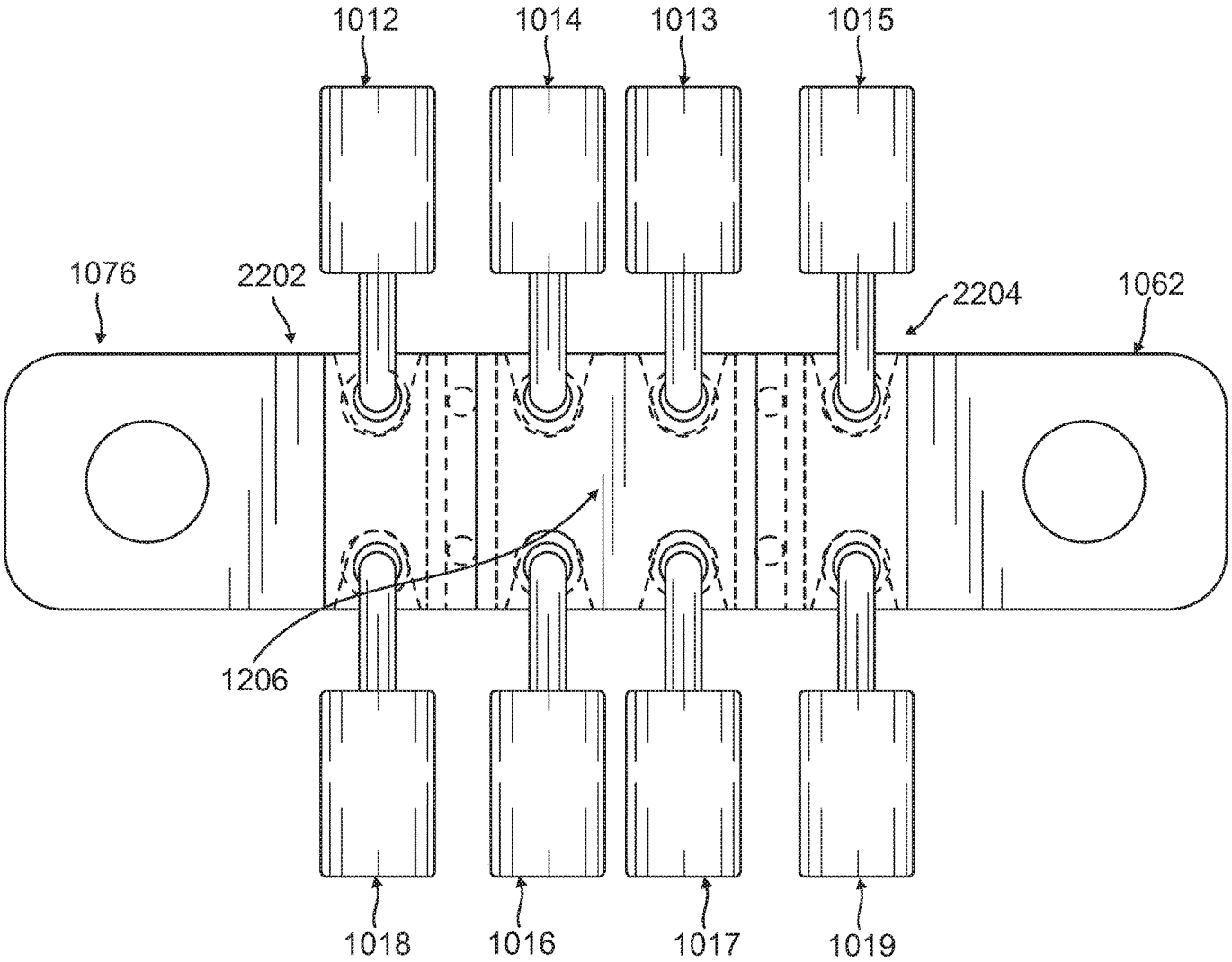
FIG. 6 is a top view of the present invention improved multiple-lock securing system illustrating eight locks affixed to two adjacent locking plates, an improved middle bar connected between the two locking plates, and an improved end bar located on each side of the improved middle bar.

Referring now to FIGS. 3, 4, and 6 there is shown an arrangement for using a plurality of locking plates such as the locking plates 1022 and 1622. This embodiment can be used when more than four locks provide access to the system. Improved middle bar 1206 shown enlarged in FIG. 5 is utilized to interconnect a first locking plate system 2202 to a second locking plate system 2204. Improved middle bar 1206 provides the same function as the improved end bars 1076 and 1062 by allowing a user who releases one of locks 1014, 1013, 1016, or 1017 to be able to remove improved middle bar 1206 there by granting access to and creating an opening by which there is a break of the integral structure formed from first locking plate system 2202, the second locking plate system 2204, and connected chains (not illustrated).

Should it be necessary or desirable to utilize less than four locks in the arrangement of FIG. 1 or eight locks in the arrangement of FIG. 6, the aligned openings in any one of the corners of the locking could be replaced by a rivet. Additionally, it should be understood that the arrangement of FIG. 6 could be further arranged or extended for additional locking plate systems, thereby making provision for adding any multiplicity of four additional locks.

The present invention improved multiple-lock securing system 1010 have end bars 1076 and 1062 and a middle bar 1206 made of metal, steel, metal alloys, hard plastic, hard rubber, or stone.

Of course the present invention is not intended to be restricted to any particular form or arrangement, or any specific embodiment, or any specific use, disclosed herein, since the same may be modified in various particulars or relations without departing from the spirit or scope of the claimed invention hereinabove shown and described of which the apparatus or method shown is intended only for illustration and disclosure of an operative embodiment and not to show all of the various forms or modifications in which this invention might be embodied or operated.

What is claimed is:

1. An apparatus for retaining a multiplicity of individual locks with each lock having its shackle in a locked condition, the apparatus comprising:

a. an upper locking plate aligned above a lower locking plate, the upper locking plate having a circumferential exterior sidewall aligned with a circumferential exterior sidewall of the lower locking plate, the upper locking plate secured to the lower locking plate by a spacer which extends transversely at the center of the upper and lower locking plates and is positioned between the upper locking plate and the lower locking plate to form a gap between the upper and lower locking plates on opposite sides of the spacer;

b. the upper locking plate including a first corner portion having a first transverse opening extending through the upper locking plate from a top surface to a bottom surface, and a second corner portion having a second transverse opening extending through the upper locking plate from the top surface to a bottom surface;

c. the lower locking plate including a first corner portion having a first transverse opening extending through the lower locking plate from a top surface to a bottom surface, and a second corner portion having a second transverse opening extending through the lower locking plate from the top surface to the bottom surface;

d. a respective first and second transverse opening in the upper locking plate aligned with a respective first and second transverse opening in the lower locking plate;

e. a first end bar removably retained within a first gap on one side of said spacer and between the upper surface of the lower locking plate, and the lower surface of the upper locking, plate, the first end bar including a body having a centrally located opening with an end bar first side, an end bar second side, an end bar third side, an end bar fourth side, an end bar top surface and an end bar bottom surface, the first end bar also has a central axis which divides the first end bar into a first half and a second half with the first half being symmetrical to and a mirror image of the second half, the first and second side combine to form a central opening along the centerline and extending from the first end bar top surface to the first end bar bottom surface, a strengthening rib extends from the first end bar first side to the first end bar second side and extends on opposite ends of a semicircular cutout;

f. said first end bar third side has a substantially U-shaped cutout that is defined by a sidewall that extends from a first opening formed by a first inwardly sloped sidewall and a spaced apart second inwardly sloped sidewall having oppositely converging angles for a perpendicular distance from the third side towards the end bar central axis and terminates at a first apex;

g. said first end bar fourth side has a substantially U-shaped cutout that is defined by a sidewall that extends from a first opening formed by a first inwardly sloped sidewall and a spaced apart second inwardly sloped sidewall having oppositely converging angles for a perpendicular distance from the fourth side towards the end bar central axis and terminates at a second apex;

h. a corner where the first side and third side of the first end bar meet is rounded, a corner where the first side and fourth side of the first end bar meet is rounded, a corner where the second side end and third side of the first end bar meet is rounded, and a corner where the second side and fourth side of the first end bar meet is rounded; and i. the upper locking plate including a transverse cutout extending from a first end of the circumferential wall to a transverse separator, j. whereby, said first end bar is inserted through said gap in said locking plate so that the second end rests against the separator, the first substantially U-shaped cutout of the first end bar is aligned between said first openings in said upper and lower locking plates and the second substantially U-shaped cutout of the first end bar is aligned between said second openings in said upper and lower locking plates, and the strengthening rib in the first end bar is aligned with the first cutout in the upper locking plate, a lock with a first shackle is retained between the first openings in said upper and lower locking surfaces and a second lock with shackle is retained between the second openings in the upper and lower locking plates, and lower locking plates, the central opening in the first end bar supports a heavy chain;

k. whereby, when either lock is opened, the first end bar is removed by the rounded corner and a U-shaped member is rotated around an open shackle of one of the locks.

2. The apparatus in accordance with claim 1, further comprising:

a. the upper locking plate including a third corner portion having a third transverse opening extending through the upper locking plate from a top surface to a bottom surface, and a fourth corner portion having a fourth transverse opening extending through the upper locking plate from the top surface to the bottom surface;

b. the lower locking plate including, a third corner portion having a third transverse opening extending through the lower locking plate from a top surface to a bottom surface, and a fourth corner portion having a fourth transverse opening extending through the lower locking plate from the top surface to a the bottom surface;

c. a respective third and fourth transverse opening in the upper locking plate aligned with a respective third and fourth transverse opening in the lower locking plate;

d. a second end bar removably retained within a second gap between a second sidewall between the upper surface of the lower locking plate, and the lower surface of the upper locking, plate, the second end bar including a body having a centrally located opening with an end bar first side, an end bar second side, an end bar third side, an end bar fourth side, an end bar top surface and an end bar bottom surface, the first end bar also has a central axis which divides the first end bar into a first half and a second half with the first half being symmetrical to and a mirror image of the second half, the first and second side combine to form a central opening along the centerline and extending from the second end bar top surface to the second end bar bottom surface, a strengthening rib extends from the second end bar first side to the second end bar second side and extends on opposite ends of a semicircular cutout;

e. said second end bar third side has a substantially U-shaped cutout that is defined by a sidewall that extends from a first opening formed by a first inwardly sloped sidewall and a spaced apart second inwardly sloped sidewall having oppositely converging angles for a perpendicular distance from the third side towards the end bar central axis and terminates at a first apex;

f. said second end bar fourth side has a substantially U-shaped cutout that is defined by a sidewall that extends from a first opening formed by a first inwardly sloped sidewall and a spaced apart second inwardly sloped sidewall having oppositely converging angles for a perpendicular distance from the fourth side towards the end bar central axis and terminates at a second apex;

g. a corner where the first side and third side of the second end bar meet is rounded, a corner where the first side and fourth side of the second end bar meet is rounded, a corner where the second side end and third side of the second end bar meet is rounded, and a corner where the second side and fourth side of the second end bar meet is rounded; and h. the upper locking plate including a transverse cutout extending from a second side end of the circumferential wall to a transverse separator;

i. whereby, said second end bar is inserted through said gap in said locking plate so that the second end rests against the separator, the first substantially U-shaped cutout of the second end bar is aligned between said third openings in said upper and lower locking plates and the second substantially U-shaped cutout of the second end bar is aligned between said fourth openings in said upper and lower locking plates, and the strengthening rib in the second end bar is aligned with the second cutout in the upper locking plate, a lock with a third shackle is retained between the third openings in said upper and lower locking surfaces and a second lock with shackle is retained between the fourth openings in the upper and lower locking plates, and the central opening in the second end bar supports a heavy chain;

j. whereby, when either lock is opened, the second end bar is removed by the rounded corner and a U-shaped member rotated around an open shackle.

3. An apparatus for retaining a multiplicity of individual locks having its shackle in a locked condition, the apparatus comprising:

a. a first upper locking plate aligned above a first lower locking plate, the first upper locking plate having a circumferential exterior sidewall aligned with a circumferential exterior sidewall of the lower locking plate, the first upper locking plates secured to the first lower locking plate by a spacer which extends transversely at the center of the upper and lower locking plates and is positioned between the first upper locking plate and the first lower locking plate to form a gap between the first upper and first lower locking plates on opposite sides of the spacer;

b. the first upper locking plate including a first corner portion having a first transverse opening extending through the first upper locking plate from a top surface to a bottom surface, a second corner portion having a second transverse opening extending through the first upper locking plate from a the top surface to a the bottom surface, a third corner portion having a third transverse opening extending through the first upper locking plate from the top surface to the bottom surface, and a fourth corner portion having a fourth transverse opening extending through the first upper locking plate from the top surface to the bottom surface;

c. the first lower locking plate including a first corner portion having a first transverse opening extending through the first lower locking plate from a top surface to a bottom surface, a second corner portion having a second transverse opening extending through the first lower locking plate from the top surface to the bottom surface, the first lower locking plate including a third corner portion having a third transverse opening extending through the first lower locking plate from a the top surface to the bottom surface, a fourth corner portion having a fourth transverse opening extending through the first lower locking plate from the top surface to a the bottom surface;

d. a respective first, second, third and fourth transverse opening in the first upper locking plate aligned with a respective first, second, third and fourth transverse opening in the first lower locking plate;

e. a first end bar removably retained within a first gap on one side of said spacer and between the upper surface of the first lower locking plate and the lower surface of the first upper locking member, plate, the first end bar including a body having a centrally located opening with an end bar first side, an end bar second side, an end bar third side, an end bar fourth side, an end bar top surface and an end bar bottom surface, the first end bar also has a central axis which divides the first end bar into a first half and a second half with the first half being symmetrical to and a mirror image of the second half, the first and second side combine to form a central opening along the centerline and extending from the first end bar to top surface to the first end bar bottom surface, a strengthening rib extends from the first end bar first side to the first end bar second side and extends on opposite ends of a the semicircular cutout;

f. said first end bar third side has a substantially U-shaped cutout that is defined by a sidewall that extends from a first opening formed by a first inwardly sloped sidewall and a spaced apart second inwardly sloped sidewall having oppositely converging angles for a perpendicular distance from the third side towards the end bar central axis and terminates at a first apex;

g. said first end bar fourth side has a substantially U-shaped cutout that is defined by a sidewall that extends from a first opening formed by a first inwardly sloped sidewall and a spaced apart second inwardly sloped sidewall having oppositely converging angles for a perpendicular distance from the fourth side towards the end bar central axis and terminates at a second apex;

h. a corner where the first side and third side of the first end bar meet is rounded, a corner where the first side and fourth side of the first end bar meet is rounded, a corner where the second side end and third side of the first end bar meet is rounded, and a corner where the second side and fourth side of the first end bar meet is rounded;

i. the first upper locking plate including a transverse cutout extending from a first end of the circumferential wall to the transverse separator;

j. said first end bar is inserted through said gap in said locking plate so that the second end rests against the separator, the first substantially U-shaped cutout of the first end bar is aligned between said first openings in said first upper and lower locking plates and the second substantially U-shaped cutout of the first end bar is aligned between said second openings in said first upper and lower locking plates, and the strengthening rib in the end plate is aligned with the first cutout in the upper locking plate, a lock with a first shackle is retained between the first openings in said first upper and lower locking surfaces and a second lock with shackle is retained between the second openings in the first upper and lower locking plates, and first lower locking plates, the central opening in the first end plate supports a heavy chain;

k. a middle bar having a middle bar first side, a middle bar second side, a middle bar third side, a middle bar fourth side, a middle bar top surface and a middle bar bottom surface, a middle bar central axis which divides a first half and second half with first half being symmetrical to and a mirror image of the second half, the widths of middle bar first side, middle bar second side, middle bar third side, and middle bar fourth side define the perpendicular distance between middle bar top surface and middle bar bottom surface;

l. middle bar third side has a first opening including a first substantially U-shaped cutout that is defined by a sidewall that extends from a first opening and a spaced apart second opening extending at oppositely converging inward angles towards middle bar central axis and terminating at a first apex, middle bar third side also has a second opening including a second substantially U-shaped cutout that is defined by a sidewall that extends from a third opening and a spaced apart fourth opening converging at inward angles towards middle bar central axis and terminating at a second apex;

m. middle bar fourth side has a third opening including a fifth substantially U-shaped cutout that is defined by a sidewall that extends from a fifth opening and a spaced apart sixth opening extending at oppositely converging inward angles towards middle bar central axis and terminating at a third apex, middle bar fourth side also has a fourth opening including a seventh substantially U-shaped cutout that is defined by a sidewall that extends from a seventh opening and a spaced apart eighth opening converging at inward angles towards middle bar central axis and terminating at a fourth apex;

n. a second upper locking plate aligned above a second lower locking plate, the second upper locking plate having a circumferential exterior sidewall aligned with a circumferential exterior sidewall of the second lower locking plate, the second upper locking plate secured to the second lower locking plate by a spacer which extends transversely at the center of the second upper and lower locking plates and is positioned between the second upper locking plate and the second lower locking plate to form a gap between the second upper and lower locking plate on opposite sides of the spacer;

o. the second upper locking plate including a first corner portion having a first transverse opening extending through the second upper locking plate from a top surface to a bottom surface, a second corner portion having a second transverse opening extending through the second upper locking plate from a top surface to a bottom surface, a third corner portion having a third transverse opening extending through the second upper locking plate from a top surface to a bottom surface, and a fourth corner portion having a fourth transverse opening extending through the second upper locking plate from a top surface to a bottom surface;

p. the second lower locking plate including a first corner portion having a first transverse opening extending through the second lower locking plate from a top surface to a bottom surface, a second corner portion having a second transverse opening extending through the second lower locking plate from a top surface to a bottom surface, the second lower locking plate including a third corner portion having a third transverse opening extending through the second lower locking plate from a top surface to a bottom surface, a fourth corner portion having a fourth transverse opening extending through the second lower locking plate from a top;

q. a respective first, second, third and fourth transverse opening in the second upper locking plate aligned with a respective first, second, third and fourth transverse opening in the second lower locking plate;

r. said second end bar third side has a substantially U-shaped cutout that is defined by a sidewall that extends from a first opening formed by a first inwardly sloped sidewall and a spaced apart second inwardly sloped sidewall having oppositely converging angles for a perpendicular distance from the third side towards the end bar central axis and terminates at a first apex;

s. said second end bar fourth side has a substantially U-shaped cutout that is defined by a sidewall that extends from a first opening formed by a first inwardly sloped sidewall and a spaced apart second inwardly sloped sidewall having oppositely converging angles for a perpendicular distance from the fourth side towards the end bar central axis and terminates at a second apex;

t. a corner where the first side and third side of the second end bar meet is rounded, a corner where the first side and fourth side of the second end bar meet is rounded, a corner where the second side end and third side of the second end bar meet is rounded, and a corner where the second side and fourth side of the second end bar meet is rounded;

u. the second upper locking plate including a transverse cutout extending from a second side end of the circumferential wall to the transverse separator;

v. said second end bar is inserted through said gap in said second locking plate so that the second end rests against the separator, the first substantially U-shaped cutout of the second end bar is aligned between said third openings in said second upper and lower locking plates and the second substantially U-shaped cutout of the second end bar is aligned between said fourth openings in said upper and lower locking plates, and the strengthening rib in the second end bar is aligned with the second cutout in the upper locking plate, a lock with a third shackle is retained between the third openings in said upper and lower locking surfaces and a second lock with shackle is retained between the fourth openings in the upper and lower locking plates, and the central opening in the second end plate supports a heavy chain; and w. said middle bar joins said first upper and lower locking plates to said second upper and lower locking plates with the middle bar first opening aligned between the upper and lower third openings in the first upper and lower locking plates and the middle bar has a second opening aligned between the upper and lower fourth opening in the first upper and lower locking plates with the middle bar third opening aligned between the upper and lower first openings in the second upper and lower locking plates and the middle bar has a fourth opening aligned between the upper and lower second opening in the second upper and lower locking plates.

4. A locking apparatus comprising:

a. a first upper locking plate and a first lower locking plate aligned in common planes, separated by a spacer and affixed together;

b. said first upper locking plate including four first, second, third and fourth upper openings sized to receive a respective lock shackle and said first lower locking plate including four first, second, third and fourth lower openings sized to receive a respective lock shackle;

c. said four upper openings respectively are aligned directly above said four lower openings;

d. a first removably retained end bar having a body with a centrally located opening, an end bar first side, an end bar second side, an end bar third side, an end bar fourth side, an end bar top surface, and an end bar bottom surface;

e. said first removably retained end bar having a central axis which divides said removably retained end bar into a first half and a second half with said first half being symmetrical to and a mirror image of said second half;

f. said first end bar first side, said first end bar second side, said first end bar third side, and said first end bar fourth side define a perpendicular distance between said first end bar top surface and said first end bar bottom surface;

g. said first end bar third side having a substantially U-shaped cutout defined by a sidewall that extends inwardly from a first opening and a second opening at oppositely converging angles for a perpendicular distance towards an the end bar central axis and terminates at a first apex;

h. said first end bar fourth side having a substantially U-shaped cutout defined by a sidewall that extends inwardly from a first opening and a second opening at oppositely converging angles for a perpendicular distance towards the end bar central axis and terminates at a second apex;

i. said first apex is located at a distance closer to said end bar central axis to said third side and said second apex is located at a distance closer to said end bar central axis to said end bar fourth side; and j. a strengthening rib that extends from said first end bar first side to said first end bar second side;

k. wherein said removably retained first end bar is retained between said first and second openings of the first upper locking plate and said first lower locking plate when a closed shackle of a respective lock passes through each respective upper opening, each respective lower opening, and each substantially U-shaped cutout;

l. whereby said removably retained end bar is removable when at least one of the shackles in element k is opened.

5. The locking apparatus in accordance with claim 4, further comprising:

a. a second removably retained end bar having a body with a centrally located opening, an end bar first side, an end bar second side, an end bar third side, an end bar fourth side, an end bar top surface, and an end bar bottom surface;

b. said second removably retained end bar having a central axis which divides said removably retained second end bar into a first half and a second half with said first half being symmetrical to and a mirror image of said second half;

c. said second end bar first side, said second end bar second side, said second end bar third side, and said second end bar fourth side define a perpendicular distance between said second end bar top surface and said second end bar bottom surface;

d. said second end bar third side having a substantially U-shaped cutout defined by a sidewall that extends inwardly from a first opening and a second opening at oppositely converging angles for a perpendicular distance towards the second end bar central axis and terminates at a first apex;

e. said second end bar fourth side having a substantially U-shaped cutout defined by a sidewall that extends inwardly from a first opening and a second opening at oppositely converging angles for a perpendicular distance towards said second end bar central axis and terminates at a second apex;

f. said first apex is located at a distance closer to said second end bar central axis to said third side and said second apex is located at a distance closer to said second end bar central axis then to said second end bar fourth side;

g. a strengthening rib that extends from said second end bar first side to said second end bar second side;

h. wherein said removably retained second end bar is retained between said third and fourth openings of the first upper locking plate and said first lower locking plate when a closed shackle of a respective lock passes through each respective upper opening, each respective lower opening, and each substantially U-shaped cutout; and i. whereby said removably retained end bar is removable when at least one of the shackles is opened.

6. The locking apparatus in accordance with claim 4, further comprising:

a. a second upper locking plate and a second lower locking plate aligned in common planes, separated by a spacer and affixed together;

b. said second upper locking plate including four first, second, third and fourth upper openings sized to receive a respective lock shackle and said second lower locking plate including four first, second, third and fourth lower openings sized to receive a respective lock shackle;

c. said four upper openings respectively are aligned directly above said four lower openings;

d. a second removably retained end bar having a body with a centrally located opening, an end bar first side, an end bar second side, an end bar third side, an end bar fourth side, an end bar top surface, and an end bar bottom surface;

e. said removably retained second end bar having a central axis which divides said removably retained second end bar formed into a first half and a second half with said first half being symmetrical to and a mirror image of said second half;

f. said second end bar first side, said second end bar second side, said second end bar third side, and said second end bar fourth side define a perpendicular distance between said second end bar top surface and said second end bar bottom surface;

g. said second end bar third side having a substantially U-shaped cutout defined by a sidewall that extends inwardly from a first opening and a second opening at oppositely converging angles for a perpendicular distance towards a second end bar central axis and terminates at a first apex;

h. said second end bar fourth side having a substantially U-shaped cutout defined by a sidewall that extends inwardly from a first opening and a second opening at oppositely converging angles for a perpendicular distance towards said second end bar central axis and terminates at a second apex;

i. said first apex is located at a distance closer to said second end bar central axis than to said third side and said second apex is located at a distance closer to said end bar central axis then to said second end bar fourth side;

j. a strengthening rib that extends from said second end bar first side to said end bar second side;

k. a removably retained middle bar having a middle bar first side, a middle bar second side, a middle bar third side, a middle bar fourth side, a middle bar top surface, and a middle bar bottom surface;

l. said middle bar having a middle bar central axis which divides a first half and second half with said first half being symmetrical to and a mirror image of said second half;

m. said middle bar having four substantially U-shaped cutouts, a first cutout, a second cutout, a third cutout and a fourth cutout; and n. said middle bar joins said first upper and lower locking plates to said second upper and lower locking plates with the middle bar first opening aligned between the upper and lower third openings in the first upper and lower locking plates and the middle bar has a second opening aligned between the upper and lower fourth opening in the first upper and lower locking plates with the middle bar third opening aligned between the upper and lower first openings in the second upper and lower locking plates and the middle bar has a fourth opening aligned between the upper and lower second opening in the second upper and lower locking plates;

o. wherein said removably retained second end bar is retained between said third and fourth openings of the second upper locking plate and said first lower locking plate when a closed shackle of a respective lock passes through each respective upper opening, each respective lower opening, and each substantially U-shaped cutout.

7. The locking apparatus in accordance with claim 4, further comprising: said first end bar has a width between the ranges of 0.1 cm and 0.5 cm.

8. The locking apparatus in accordance with claim 4, further comprising: said perpendicular distance to said first apex is equal to said perpendicular distance to said second apex.

9. The locking apparatus in accordance with claim 6, further comprising: each said middle bar and each said first and second end bars are made from a material selected from the group consisting of metal, steel, metal alloys, hard plastic, hard rubber, and stone.

* * * * *